US005921824A

United States Patent [19]

Ilagan

[11] Patent Number: 5,921,824

[45] Date of Patent: Jul. 13, 1999

[54] WATER WORKOUT APPARATUS

[76] Inventor: Artemio M. Ilagan, P.O. Box 1815, Agana, Guam 96932

[21] Appl. No.: 09/145,203

[22] Filed: Sep. 1, 1998

[51] Int. Cl.[6] ..... B63H 16/20

[52] U.S. Cl. ..... 440/26; 440/29

[58] Field of Search ..... 440/21, 26, 27, 440/28, 29, 30, 31

[56] References Cited

U.S. PATENT DOCUMENTS 2,139,022 12/1938 Johnson .
2,834,539 2/1958 Budney et al. .
3,369,517 2/1968 Rosenthal .
3,467,049 9/1969 Turcotte .
4,511,338 4/1985 Fanelli ..... 440/26
4,795,381 1/1989 Willems ..... 440/26
5,127,855 7/1992 Heywood ..... 440/26
5,183,422 2/1993 Guiboche ..... 440/26

*Primary Examiner*—Jesus D. Sotelo
*Attorney, Agent, or Firm*—Richard C. Litman

[57] ABSTRACT

A water workout apparatus comprising a paddleboat is propelled by various means such as oscillating pedals, rotating pedals, and push-pull levers or handle bars. The paddleboat can be propelled in reverse by rotating the handle and utilizing separate reversing oscillating pedals to motivate the belt driven gear system. The paddleboat can be utilized out of the water by being supported on a pair of stands to provide physical exercise of arms and legs.

20 Claims, 15 Drawing Sheets

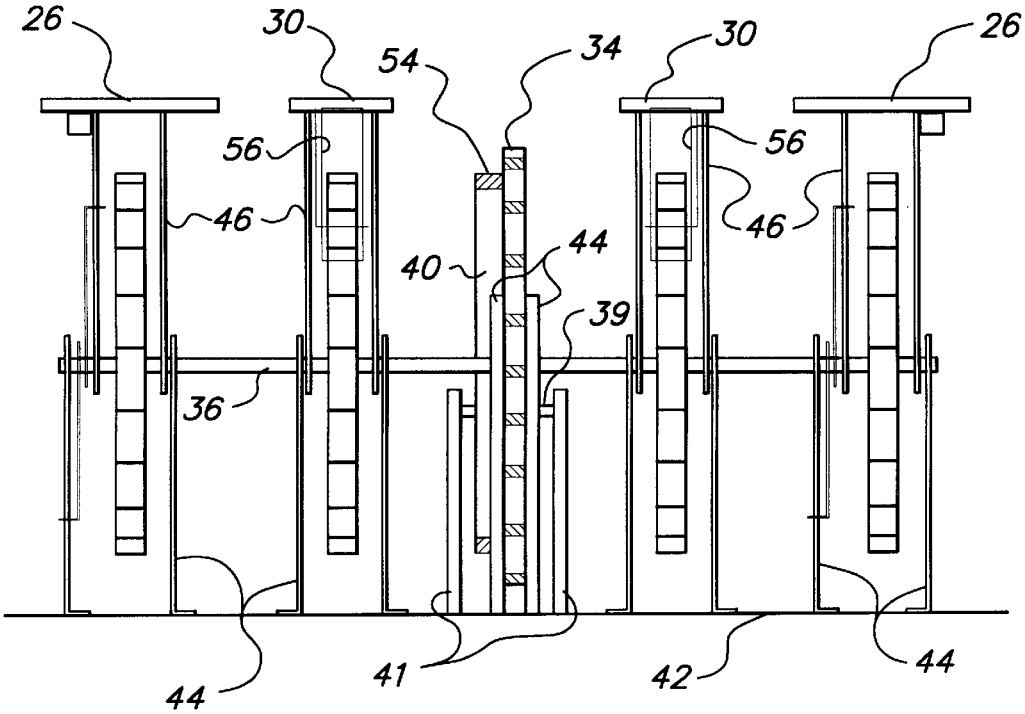
FIG. 5
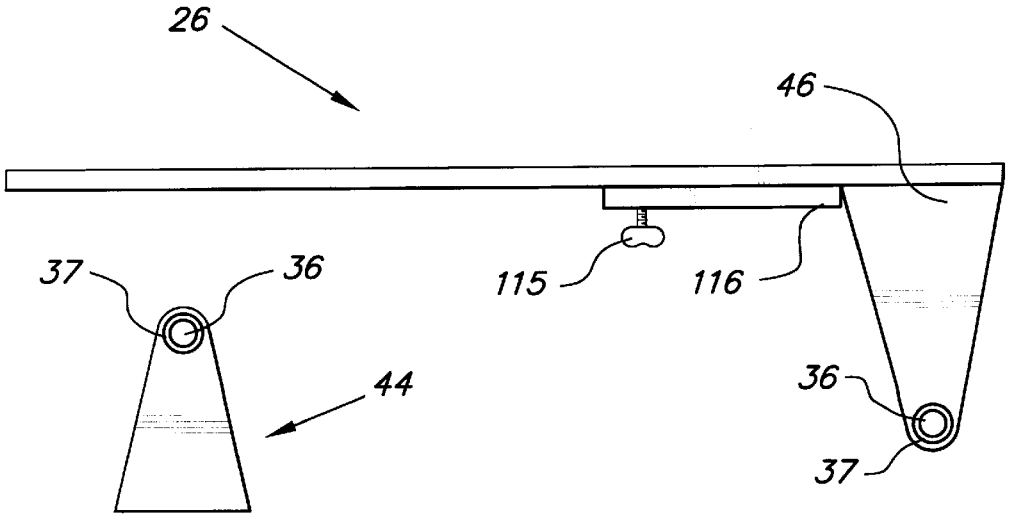
FIG. 6
FIG. 7

WATER WORKOUT APPARATUS

BACKGROUND OF THE INVENTION

1. Field Of The Invention

The present invention relates generally to exercise apparatus and watercraft. More specifically, the invent-on is a water workout system comprising a light weight cathedral hulled paddleboat propelled by various means such as oscillating pedals, rotating pedals, and push-pull levers or handle bars. In one embodiment, the paddleboat can be propelled in reverse by rotating the handle and utilizing separate reversing oscillating pedals to motivate the belt driven gear system. The cathedral hulled paddleboat can be utilized out of the water by being supported on a pair of stands.

2. Description Of The Related Art

The related art of interest describes various exercise and watercraft apparatus, but the art neither teaches nor suggests the unique water workout apparatus system of the present invention.

U.S. Pat. No. 3,467,049 issued on Sep. 16, 1969, to George J. Turcotte describes a paddle wheel boat having a triple hull, an adjustable seat and two independently driven paddle wheels in the rear connected by a sleeve. The boat is propelled and steered by pedals connected by rods to independent cranks of the paddle wheels. The boat is distinguishable for Lacking a rudder and reversing controls, and utilizing two paddle wheels driven by cranks and rods connected to the foot pedals instead of a belt and pulley system as in the present invention.

U.S. Pat. No. 4,511,338 issued on Apr. 16, 1985, to Noel Fanelli describes a water bicycle and a detachable device for converting a sail board into a water bicycle. The pedals drive two paddle wheels which can be separately lifted from the water by turning the steering handle bars. A hinged control box contains the transverse shaft of the paddle wheels and the pedals' crank gear assembly driving a notched chain attached to the transverse shaft. The water bicycle is distinguishable for its dual paddle wheel drive with its vertical movement mechanism for steering.

U.S. Pat. No. 5,183,422 issued on Feb. 2, 1993, to Thomas Guiboche describes a pedal boat comprising a chair or a seat on a circular air inflated rubber tube. Two belt-driven paddle wheels below the driver are motivated by either a driving pedal and wheel spaced closely or separated by a greater distance according to the driver's leg position. One or a pair of handles, either short for the chair mode or elongated for the seat mode, connected by a Bowden cable or the long handle, respectively, perform a clutching operation to permit the paddles to move independently for steering. The upper assembly minus the paddles and pedals can be used for ice fishing. The pedal boat is distinguishable for the required location of the paddle wheels below the driver.

U.S. Pat. No. 2,824,539 issued on Feb. 25, 1958, to Michael P. Budney et al. describes a predominantly plastic watercycle having a pair of pontoons with a bicycle in a housing to drive an enclosed pair of large disks having fins for propulsion. A rudder is attached to the steering shaft. The disks have slotted centers to enable vertical movement of the disks when grounding. The watercycle is distinguishable for its slotted disks located beneath the driver.

U.S. Pat. No. 2,139,022 issued on Dec. 6, 1938, to John G. Johnson describes an aquatic amusement device comprising a flat board with a middle opening for the operator to sit on a submerged bar and pull or push a pair of handled rods attached to hinged rectangular paddle frames. The device is distinguishable for its specific mechanical linkages to hinged paddle frames.

U.S. Pat. No. 3,369,517 issued on Feb. 20, 1968, to Harry Rosenthal describes a propulsion system for aquatic vehicles comprising a hinged paddle centered in the boat and travelling in a horizontal guideway. The operator must bend forward to push the paddle forward and then pull backward to propel the boat forward. The propulsion system is distinguishable for its oaring mechanism.

U.S. Pat. No. 4,795,381 issued on Jan. 3, 1989, to Karel Willems describes a boat driven by an operator by a treadle mechanism to energize a propeller. The treadle mechanism comprises two actuating elements which are each pivotable and are driveable by arms or legs and which are coupled by a driving shaft through a freewheel clutch. The treadle mechanism is distinguishable for its freewheeling clutch and propeller means.

U.S. Pat. No. 5,127,855 issued on Jul. 7, 1992, to William O. Heywood describes a watercraft with a bicycle format on two pontoons. The foot pedals drive a crank which oscillates an airfoil plate for propulsion. The steering shaft ends in a rudder. The watercraft is distinguishable for the oscillating airfoil plate as a propulsion means.

None of the above inventions and patents, taken either singularly or in combination, is seen to describe the instant invention as claimed. Thus, the water workout systems providing the versatility of land or water use is desired.

SUMMARY OF THE INVENTION

The present invention is a water workout system comprising a light weight cathedral hulled paddleboat propelled by various means such as oscillating pedals, rotating pedals, and push-pull levers or handle bars. In one embodiment, the paddleboat can be propelled in reverse by rotating the handle and utilizing separate reversing oscillating pedals to motivate the belt driven gear system. The cathedral hulled paddleboat can be utilized out of the water by being supported on a pair of stands.

Accordingly, it is a principal object of the invention to provide a cathedral hulled paddleboat which combines the enjoyment of water travel and physical exercise of arms, back and legs.

It is another object of the invention to provide a cathedral hulled paddleboat with a pair of forward motion pedals and a pair of reverse motion pedals.

It is a further object of the invention to provide a cathedral hulled paddleboat with a pair of hand levers for energizing the paddle wheels.

Still another object of the invention is to provide a cathedral hulled paddleboat with a bicycle format.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 5 is a front elevational view of the pedal system of the FIG. 1 embodiment including forward and reverse pedals.

FIG. 6 is a side elevational view of a bracket for a sprocket and primary gear in the FIG. 1 embodiment.

FIG. 7 is a side elevational view of a forward motion pedal and bracket in the embodiments of FIG. 1 and FIGS. 17A–C.

Similar reference characters denote corresponding features consistently throughout the attached drawings.

DETAILED DESCRIPTION OF THE PREFERRED EMBODIMENTS

Figure 1:
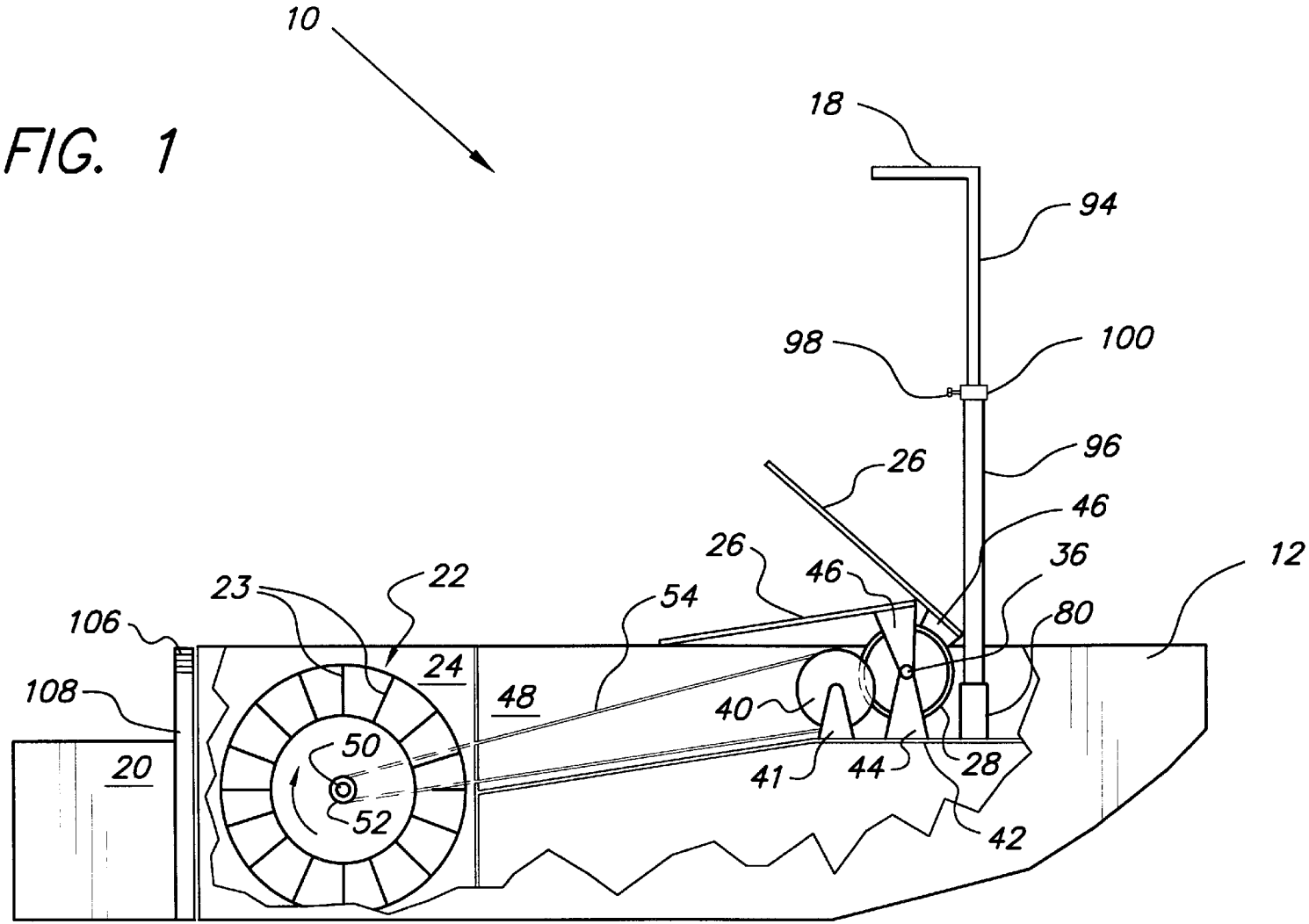
FIG. 1 is a left side elevational view with a partial breakaway of a first embodiment of a water workout system, but omitting the reverse pedals according to the present invention.
Figure 2:
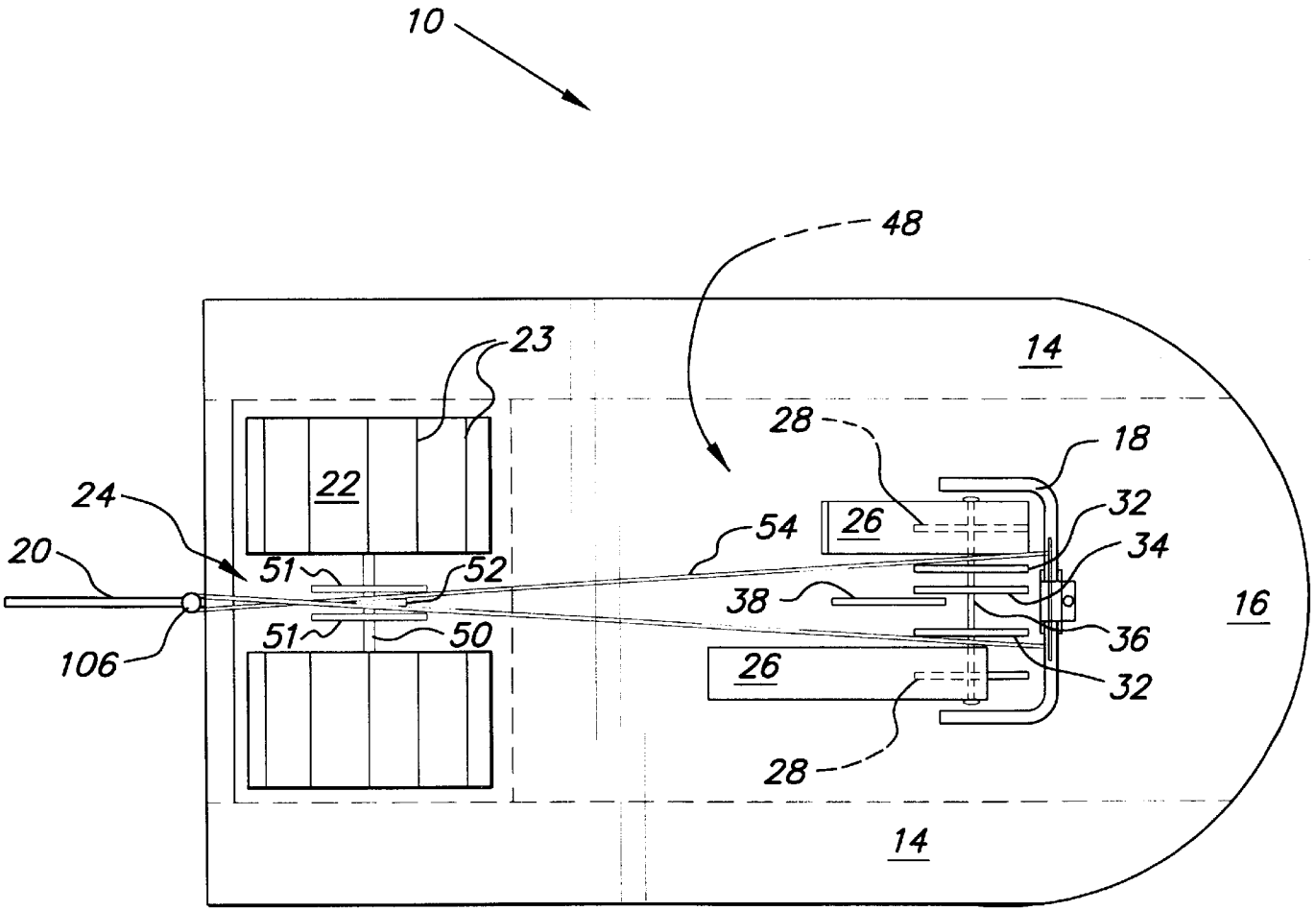
FIG. 2 is a top plan view of the FIG. 1 embodiment.
Figure 3:
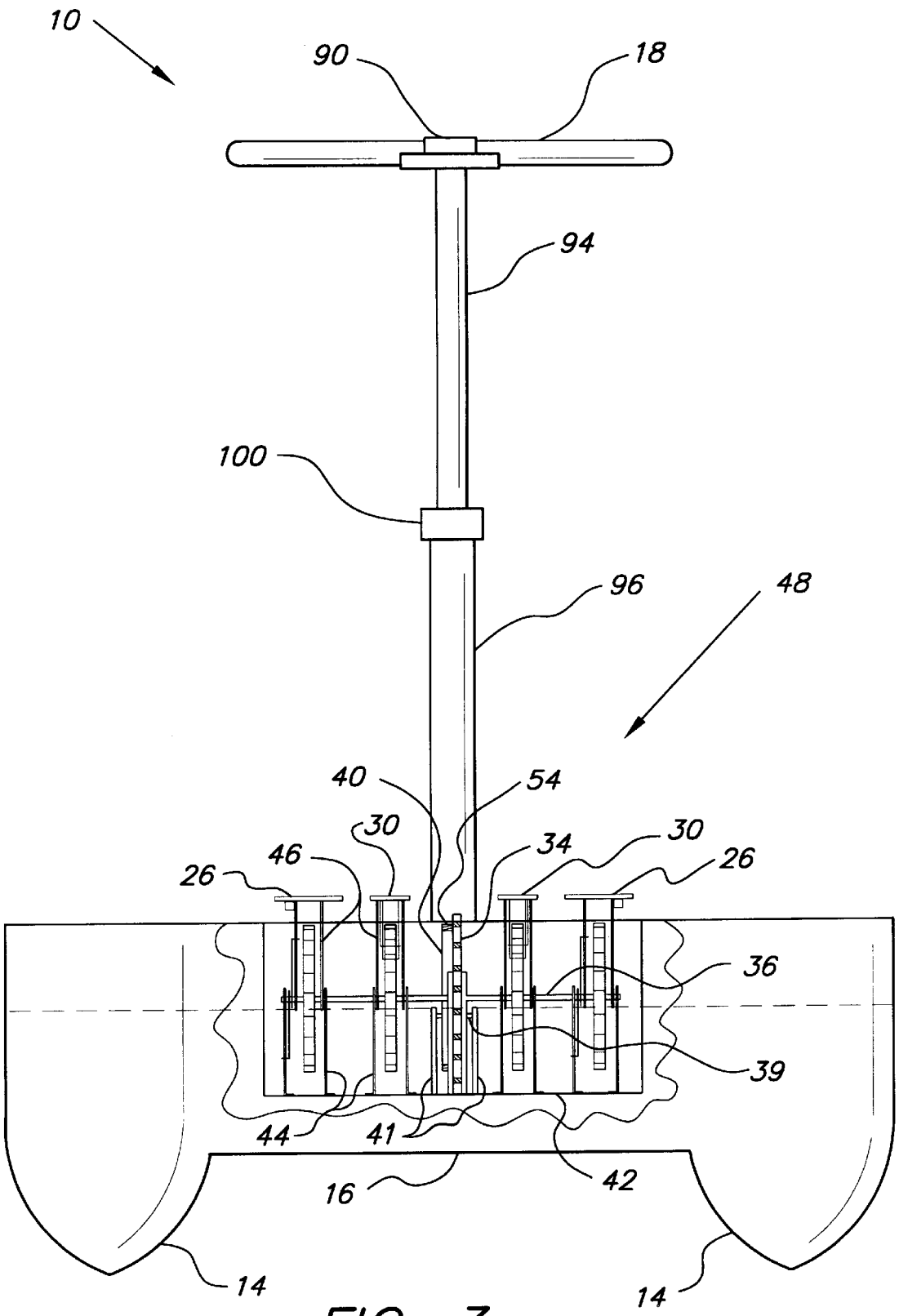
FIG. 3 is a front elevational view of the FIG. 1 embodiment.
Figure 4:
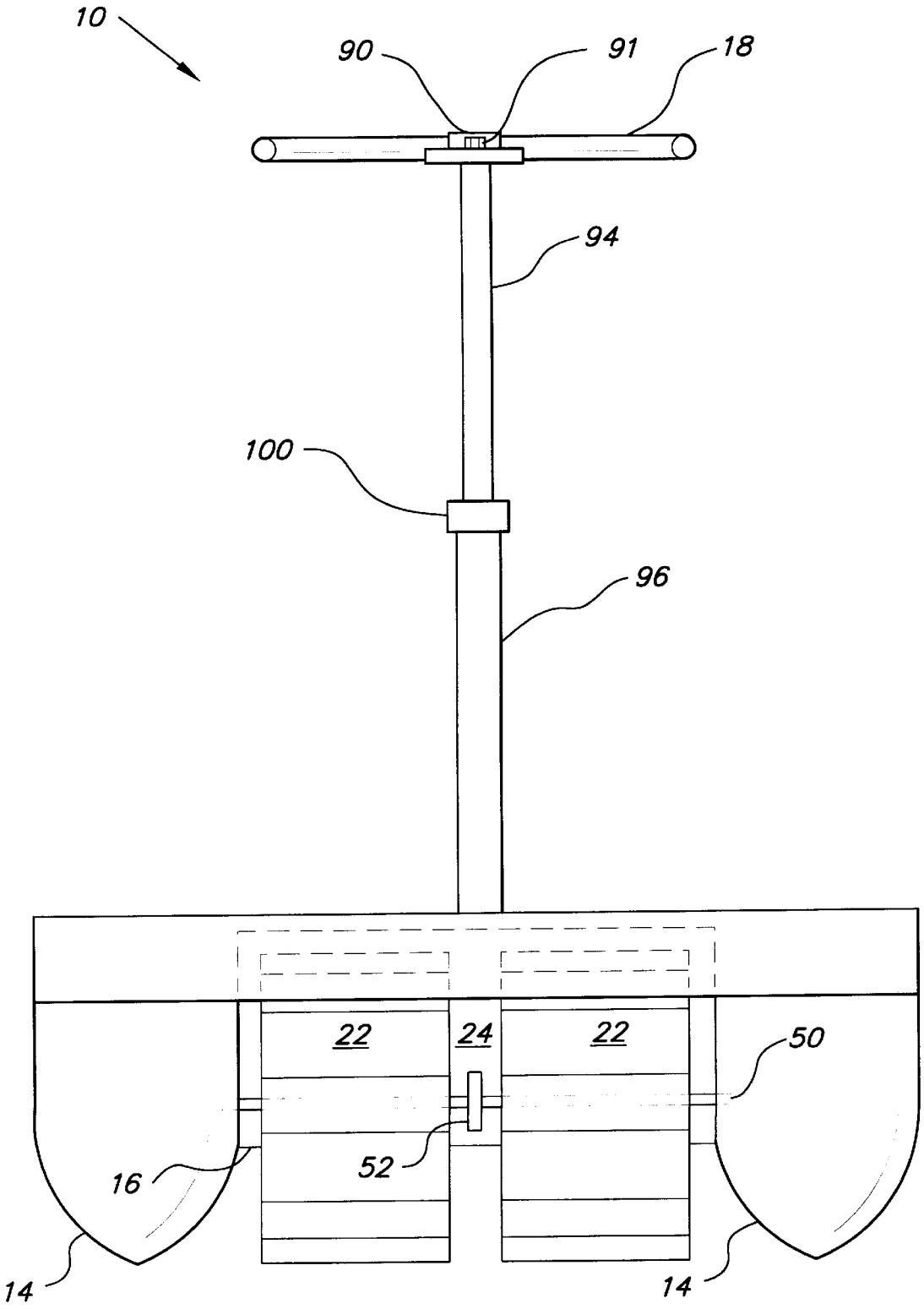
FIG. 4 is a rear elevational view of the FIG. 1 embodiment without the rudder.

A first embodiment of the present invention is illustrated in FIGS. 1–16. A first water workout apparatus 10 is based on a cathedral boat hull 12 having bottom side portions 14 shaped like pontoons with a middle shallow portion 16 (FIGS. 2–4). A U-shaped steering handle 18 forward controls a pivotal rear rudder 20. A pair of paddle wheels 22 with vanes 23 are located aft in a well or rear enclosure 24 in front of the rudder 20. All the embodiments are based on the elementary parts of the boat described so far. The driving means differ in the other embodiments.

Figure 9:
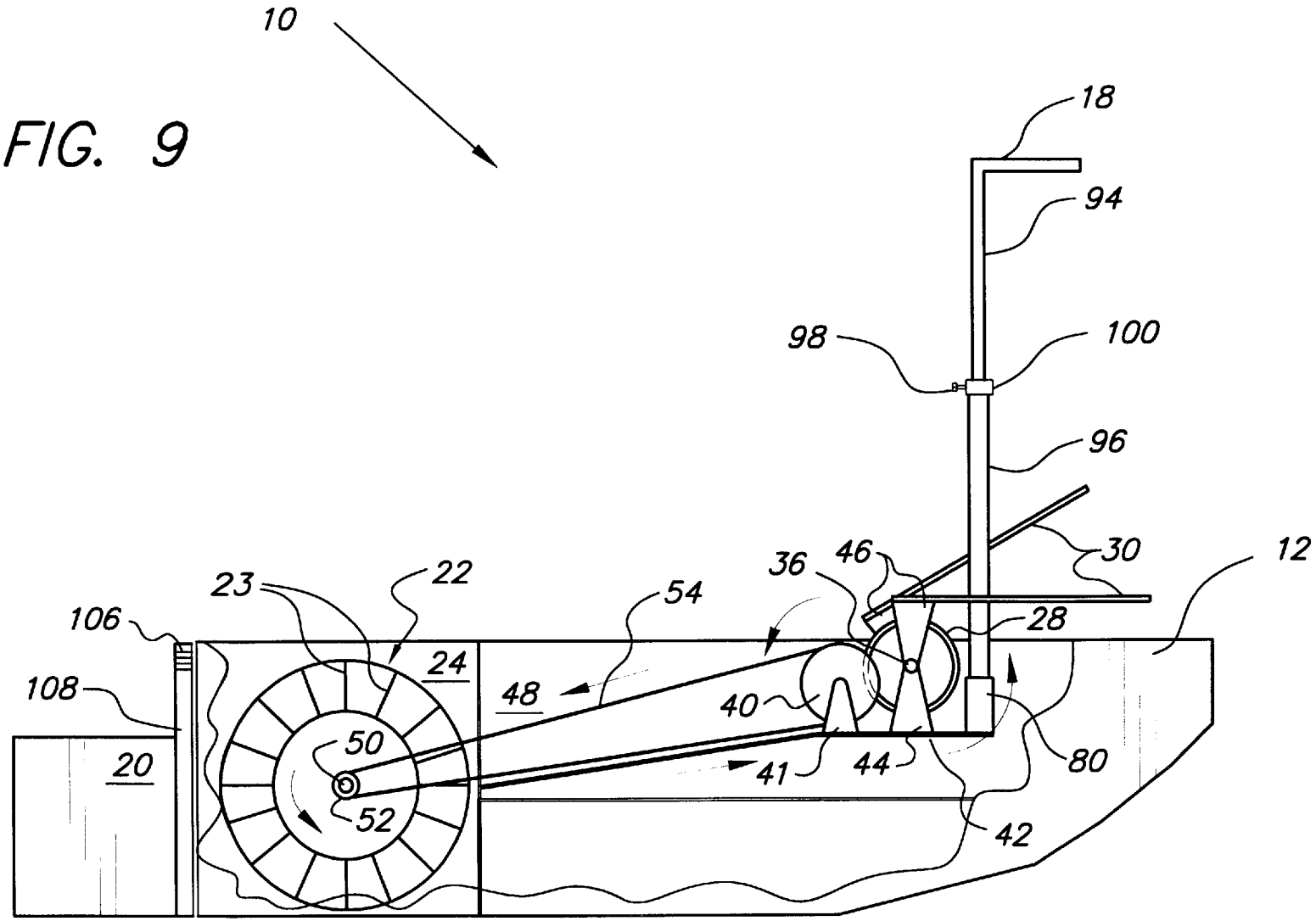
FIG. 9 is a left side elevational view of the FIG. 1 embodiment with a breakaway showing only the reverse pedals and the reversed handle with paddle wheels.
Figure 10:
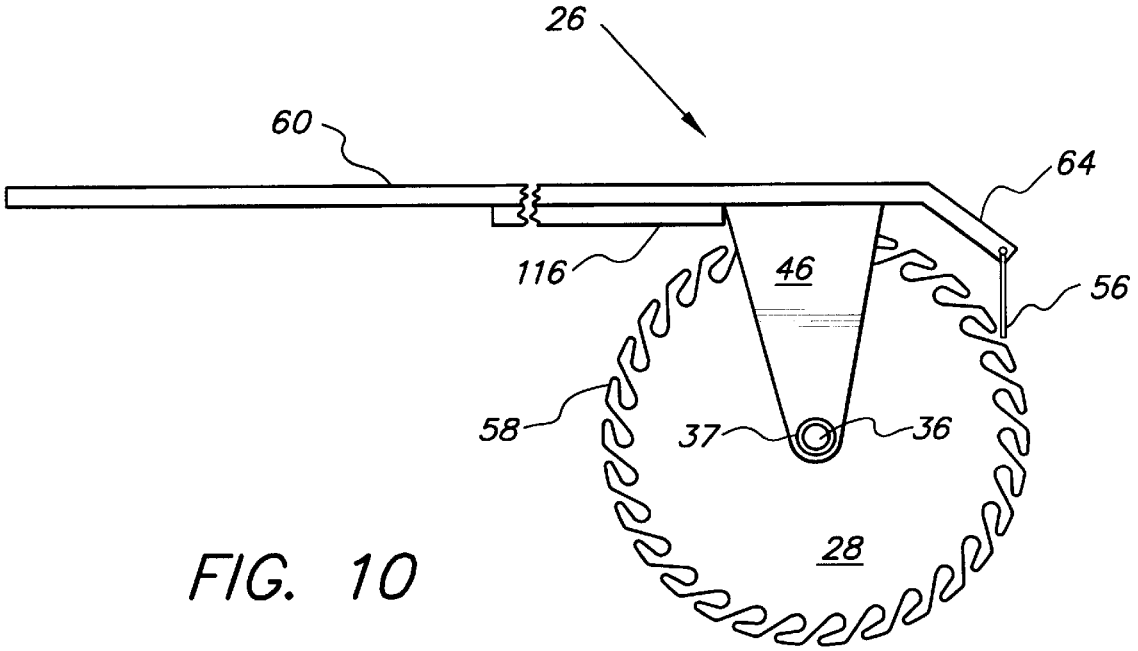
FIG. 10 is a left side elevational view of the pedal, pawl and ratchet wheel for forward motion in the FIG. 1 embodiment.
Figure 11:
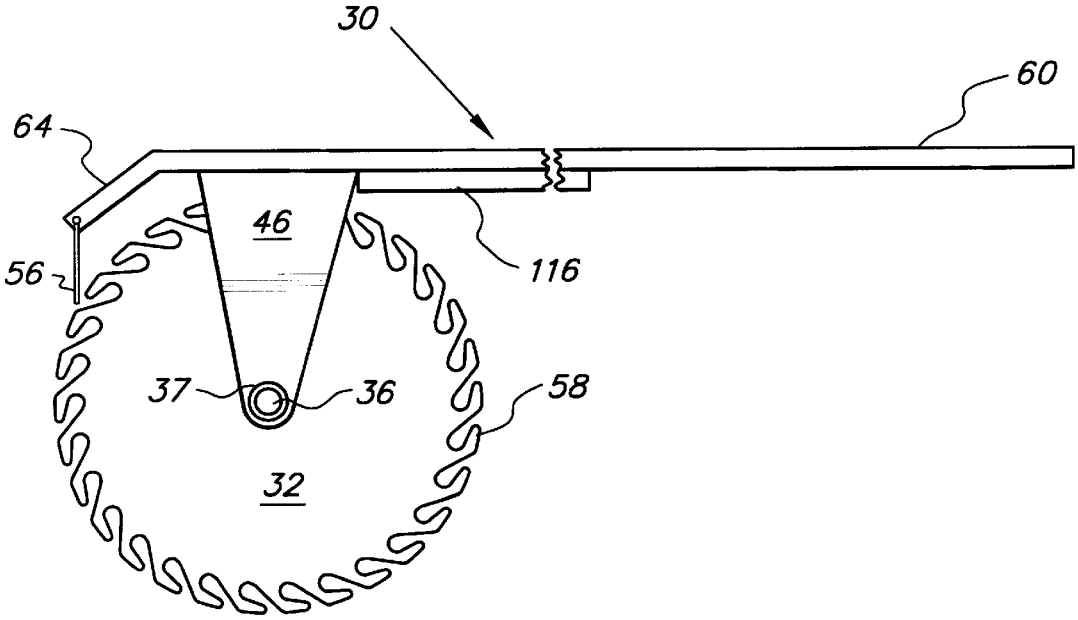
FIG. 11 is a left side elevation view of the pedal, pawl and ratchet wheel for reverse motion in the FIG. 1 embodiment.

In the first embodiment, the driving force is a pair of forward movement pedals 26 (FIGS. 1, 2, 3, 5, and 10), each pedal mounted adjacent to a first ratchet wheel 28 for advancing the first ratchet wheel. It is noted that only the forward movement pedals 26 are depicted in FIGS. 1 and 2 for the sake of clarity. A pair of reverse movement pedals 30 (FIGS. 3, 5, 9, and 11), are each mounted adjacent to a second ratchet wheel 32 having a first diameter for advancing the second ratchet wheel. It is noted that only the reverse movement pedals 30 are shown in FIG. 9 for clarity. A primary gear 34 having the same first diameter as the second ratchet wheel 32, the pair of forward movement pedals 26, the pair of reverse movement pedals 30, the first ratchet wheel 28, the second ratchet wheel 32, and the primary gear 34 are all mounted on a main axle 36 as best seen in FIGS. 3 and 5. The axle 36 is supported from the floor 42 by floor brackets 44 in bearings 37 shown in FIG. 6. The forward and reverse movement pedals 26 and 30, respectively, are supported by pedal brackets 46 having an extension bar socket 116 and a wingnut fastener 115 as shown in FIG. 7 on bearings 37 for rotation on the main axle 36.

Figure 13:
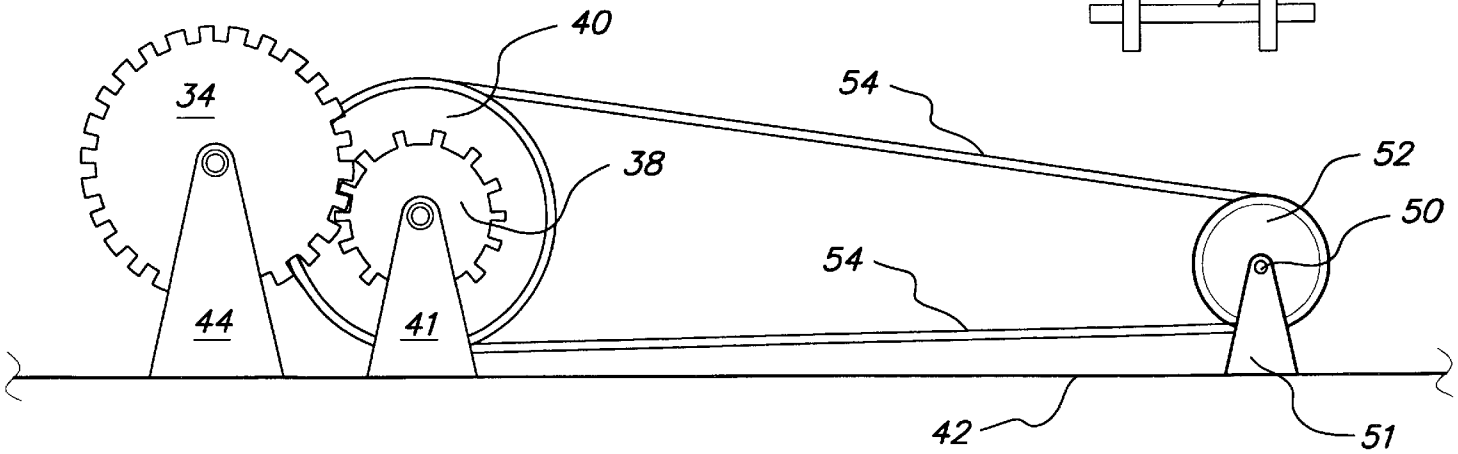
FIG. 13 is a right side elevational view of the primary and secondary gears and the secondary pulley in the FIG. 1 embodiment.

A secondary gear 38 (on a secondary axle 39 supported by brackets 41) of a smaller second diameter is contiguously attached to a primary pulley 40 (on axle 39) having a larger diameter, wherein the primary gear 34 drives the secondary gear 38 as shown in FIG. 13.

A forward enclosure or machine housing 48 is provided for containing the pair of forward movement pedals 26, the pair of reverse movement pedals 30 and the steering handle 18, inter alia.

The pair of paddle wheels 22 are mounted on an axle 50 supported by brackets 51 having a secondary pulley 52 (FIGS. 3 and 13) between the paddle wheels and contained in the well or rear enclosure 24. An endless belt 54 traverses the primary pulley 40 and the secondary pulley 52 for driving the paddle wheels 22 by reciprocal movement of the forward movement and rear movement pedals 26 and 30, respectively.

The two forward movement and rear movement pedals 26 and 30 drive the ratchet wheels 28 and 32, respectively, in a clockwise direction as the pedals are pumped up and down (FIGS. 10 and 11) by virtue of the pawl 56 (FIG. 12) engaging one of the curved teeth 58. Each downward movement of the rear portion 60 of one of the forward movement or reverse movement pedals 26 and 30 drives the paddles wheels 22. The pawl 56 on one pedal releases its hold on each upward movement due to movement of the other pedal.

Figure 12:
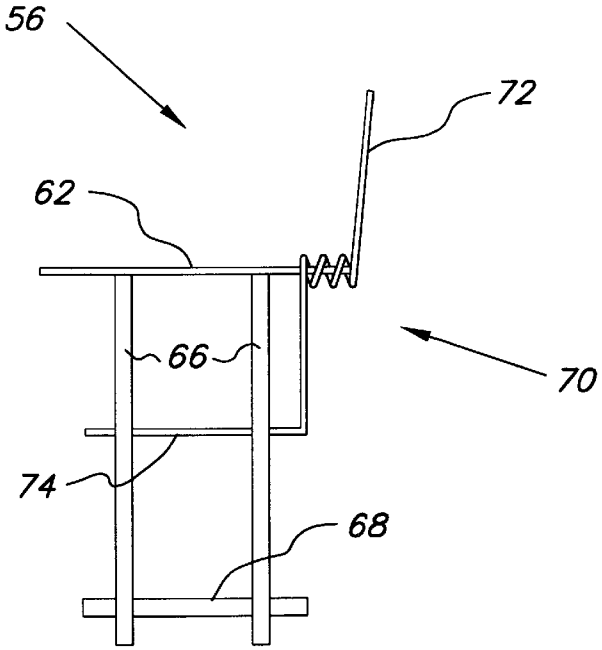
FIG. 12 is a rear elevational view of the pawl in the FIG. 1 embodiment.

FIG. 12 illustrates a rear view of the pawl 56 comprising a top rod 62 embedded in or fastened to the underside of the inclined front portion 64 of a pedal (FIG. 10) from which a pair of parallel rods 66 depend with a crossbar 68 proximate the end. A spring 70 is coiled around one end of the top rod 62 and anchored by a first end 72 beneath a pedal 26 or 30. The second opposite end 74 of the spring 70 extends across the parallel rods 66 to transmit a return force for engaging one of the curved teeth 58. The depiction of the pawl rods as being separate pieces is only exemplary and a one-piece molded pawl is contemplated.

Figure 8:
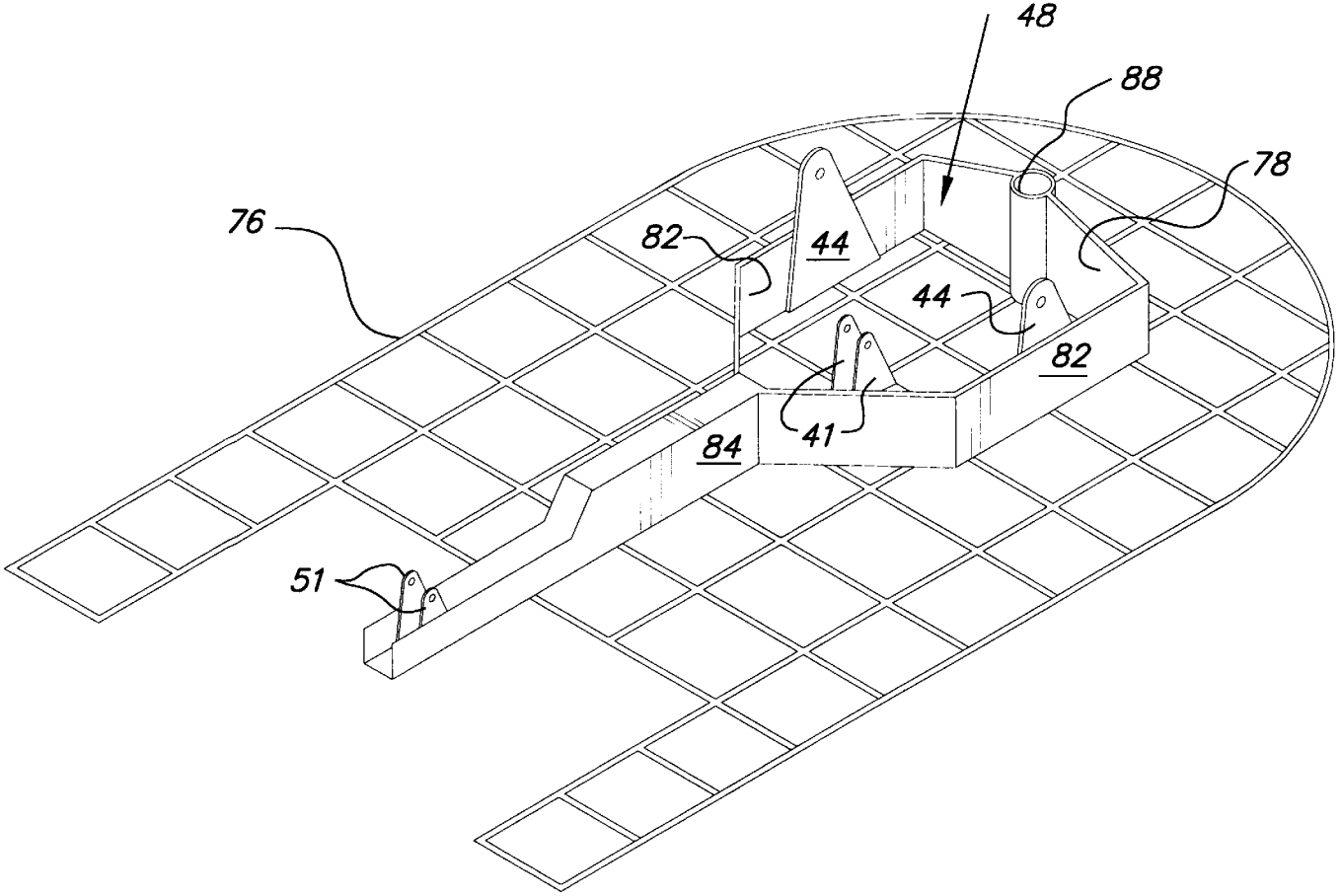
FIG. 8 is a perspective view of the machinery housing and wire mesh reinforcement of the boat in the FIG. 1 embodiment.
Figure 14:
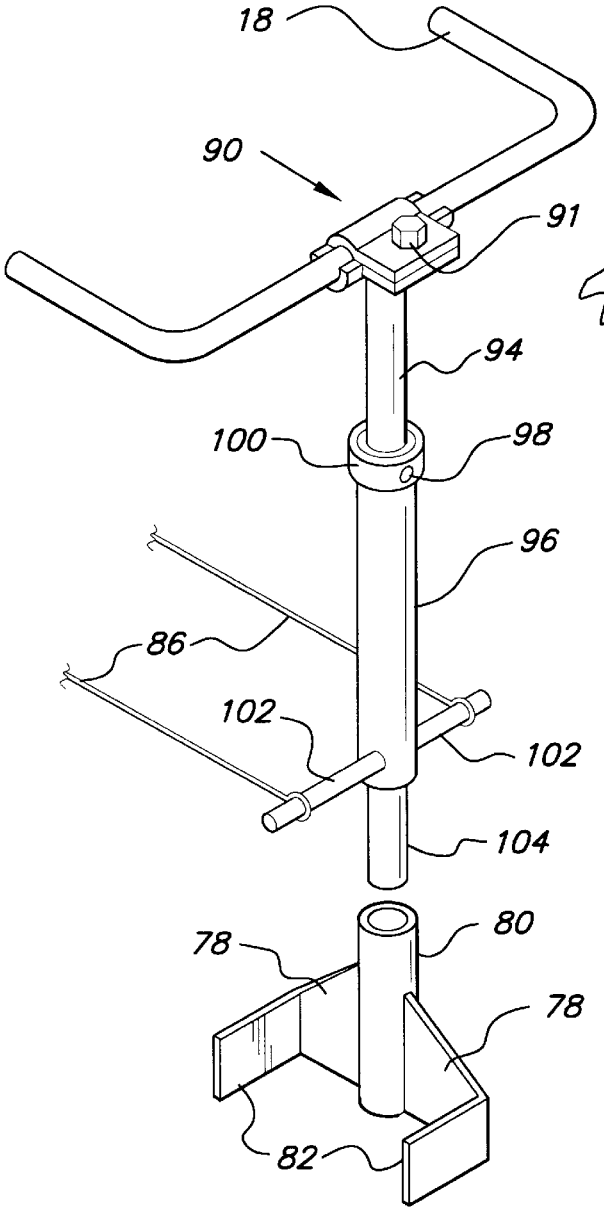
FIG. 14 is a perspective view of the steering mechanism for forward motion in the FIG. 1 embodiment.

FIG. 8 illustrates the wire mesh frame 76 reinforcing the polystyrene foam hull 12 coated inside and outside with a coating of plastic or resin (not shown). The wire can be aluminum having a diameter of 3/16 inch. The wire squares are 6 in. on a side. Centered on the frame 76 is the forward enclosure or machine housing 48. In the front wall 78 of the housing 48, a steering handle pivot socket 80 is integrated as also shown in FIG. 14. Brackets 44 for supporting the main axle 36 are supported by the sidewalls 82. The brackets 42 support the primary pulley 40 (not shown) within the forward enclosure 48. The sidewalls 82 narrow aft to form a tunnel 84 which encloses the endless belt 54 and the steering rope 86. The rearmost bracket 42 supports the axle 50 of the paddle wheels 22 (not shown).

Figure 15:
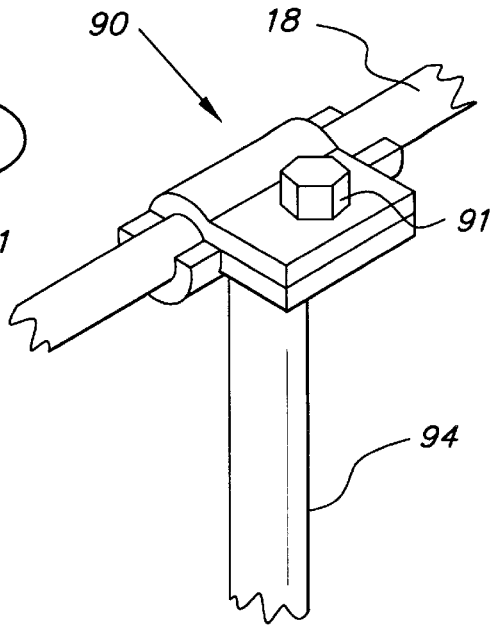
FIG. 15 is a partial view of the handle bar, steering post and the clamp in the FIG. 1 embodiment.
Figure 16:
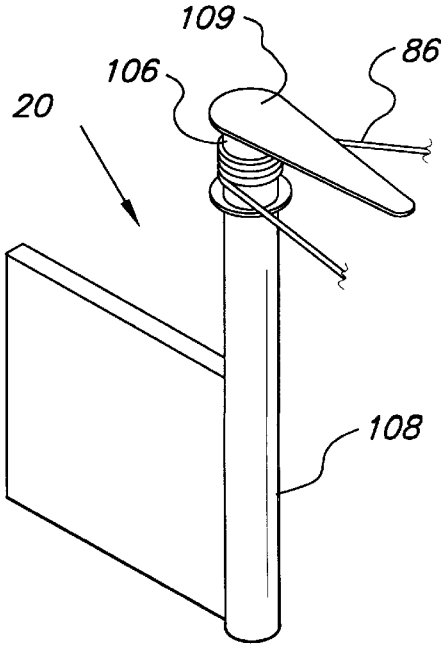
FIG. 16 is a partial perspective view of the rudder system in the FIG. 1 embodiment.

Turning now to the steering mechanism of FIGS. 14–16, the steering handle 18 is U-shaped and has a pair of stopper pins 88 in its midsection pointing forward (hidden) for engaging a clamp 90 attached by a fastener 91 to the top of the vertical steering shaft 92 comprising a telescopic steering handle post 94 inserted into a main steering shaft 96 and locked in place by a fastener 98 in a collar 100, a pair of horizontal steering sticks or posts 102 diametrically opposed on a lower portion of the main steering shaft 96, and a pivoting foot 104 which pivots in the steering handle pivot socket 80. To each post 102 is attached the end of an endless steering rope 86 which traverses a helical gear 106 positioned on a top portion of the vertical shaft 108 of the rear rudder 20 (FIG. 16), whereby the water workout apparatus 10 can be steered. A rudder handle 109 can be optionally added to the rudder shaft 108 as a precautionary aid when traveling in water and the steering rope 86 should break.

The steering handle 18 is rotated 180° to effectuate a reversing movement of the boat 10 by utilizing the reverse movement pedals 30 as depicted in FIG. 9. The forward movement pedals 26 have been purposely omitted for clarity. The opposite orientation of the curved teeth 58 of the second ratchet wheel 32 (FIG. 11) permits the operation of the reverse movement pedals 30 via the pawl 56 to motivate the paddle wheels 22 to now rotate in an opposite direction to back up the boat 10.

Figure 17A:
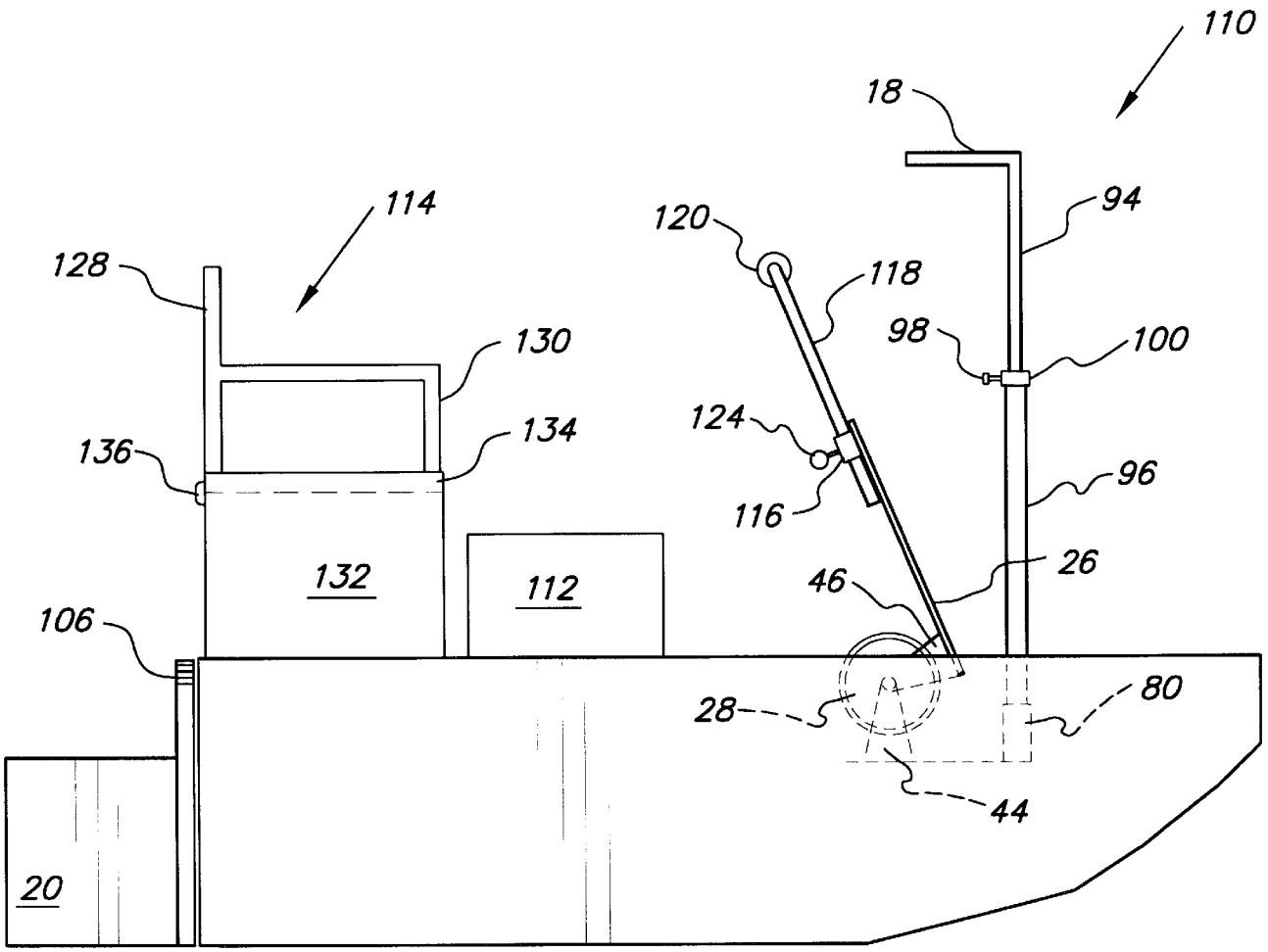
FIG. 17A is a left perspective view of a second embodiment using rowing elements and an elevated seat for the paddle boat.
Figure 17B:
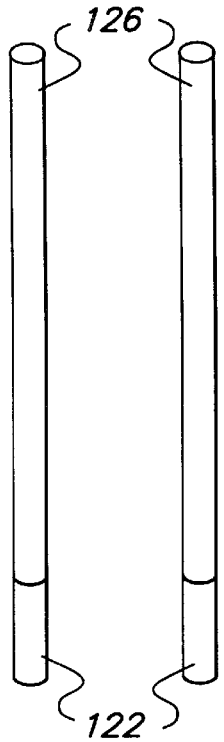
FIG. 17B is a front elevational view of a pair of straight lever bars as one alternative rowing element in the FIG. 17A embodiment.
Figure 17C:
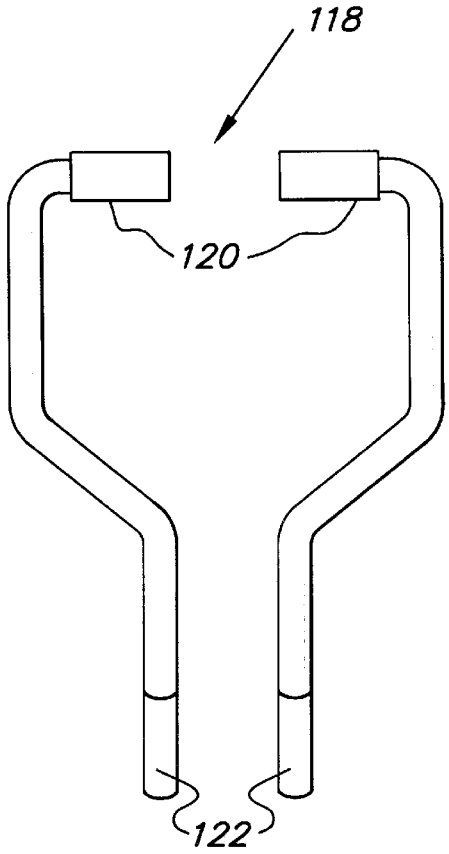
FIG. 17C is a front elevational view of a pair of question mark shaped lever bars as a second alternative rowing element shown also in FIG. 17A.

FIGS. 17A, 17B, and 17C are drawn to a second embodiment of the present invention directed to a modified exercise paddle boat 110 using rowing elements, and including an elongated seat 112, and a combination bench and cooler 114. The reverse movement pedals and their mechanical attachments can be eliminated. The forward movement pedals 26 have an extension bar socket 116 (FIG. 7) for insertion of various rowing elements such as the pair of rowing handles 118 (FIGS. 17A and 17C) shaped in the form of question marks with the upper horizontal handle grips 120 inwardly facing each other. The opposite ends 122 of the rowing handles 118 are shaped with a square cross-section for cooperating with the locking screw 124 in the extension bar socket 116. An alternative straight bar rowing handle 126 is depicted in FIG. 17B. In use, the rowing handles 118 and 126 are moved alternately back and forth with the backward movement propelling the paddle wheels 24.

The combination bench and cooler 114 comprises a backrest 128 and a pair of armrests 130 with a cooler 132 having a padded cover 134 serving as a seat. The cover 134 is hinged in the rear with a pair of hinges 136. The combination bench and cooler 114 and the elongated seat 112 extend the width of the boat 110.

Figure 18:
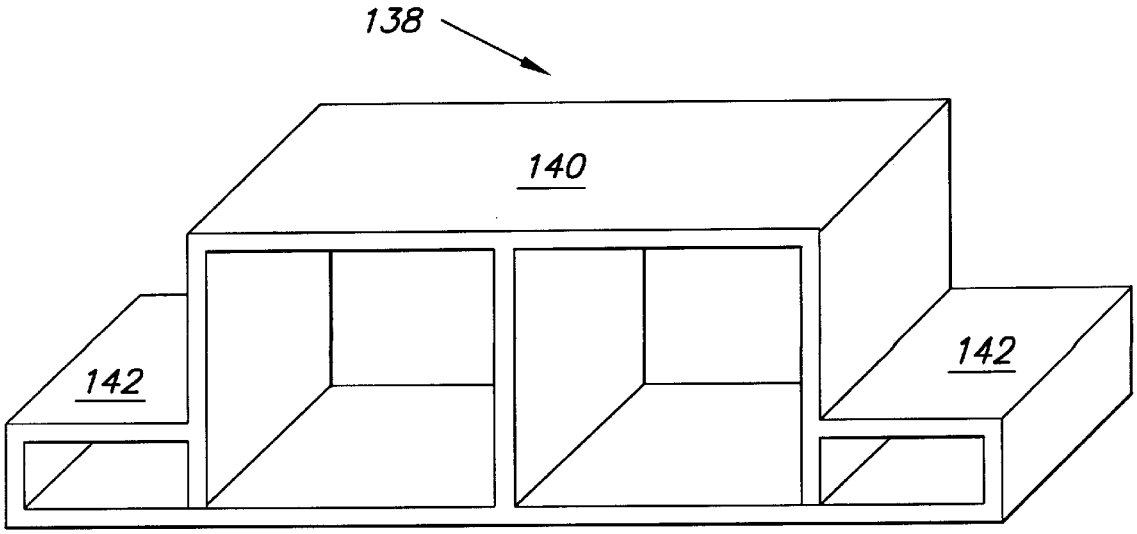
FIG. 18 is a perspective view of one of a pair of boat stands of a third embodiment utilized to support the paddle boats on land.

FIG. 18 is a third embodiment of the exercise boat apparatus involving a pair of boat stands 138, each stand comprising an elevated central portion 140 and lower shoulders 142 on each side of each central portion 140 of the stand 138 for supporting a cathedral hull paddleboat fore and aft on land. Thus, the exerciser can perform the exercises on land with the various modes of moving the paddlewheels. The light weight construction of the exercise boat apparatus permits handling for mounting on the boat stands 138 without involving lifting equipment.

Figure 19:
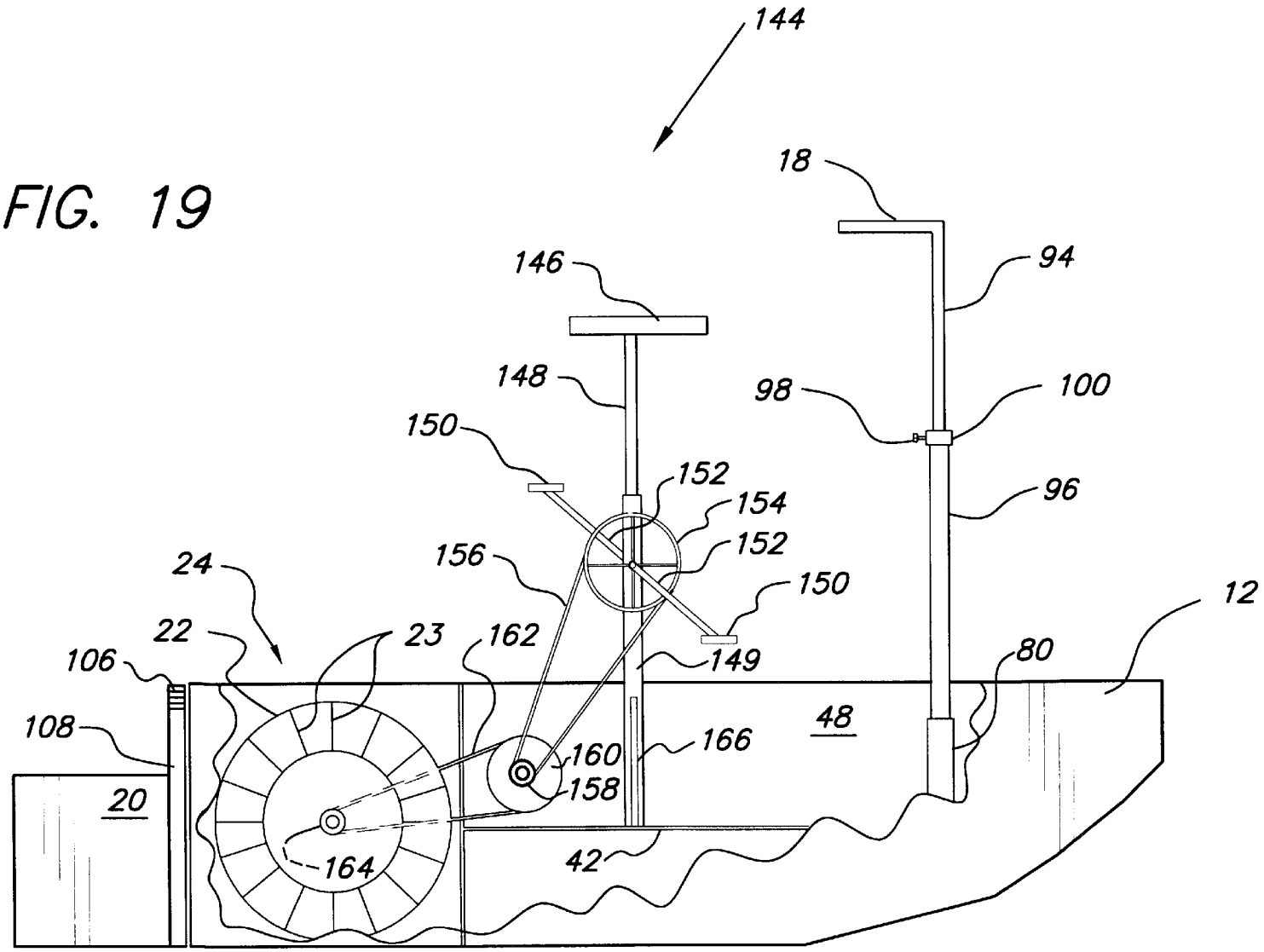
FIG. 19 is a fourth embodiment of a water workout system with a partial cutaway to show the cycling pedal and handlebar system.
Figure 20:
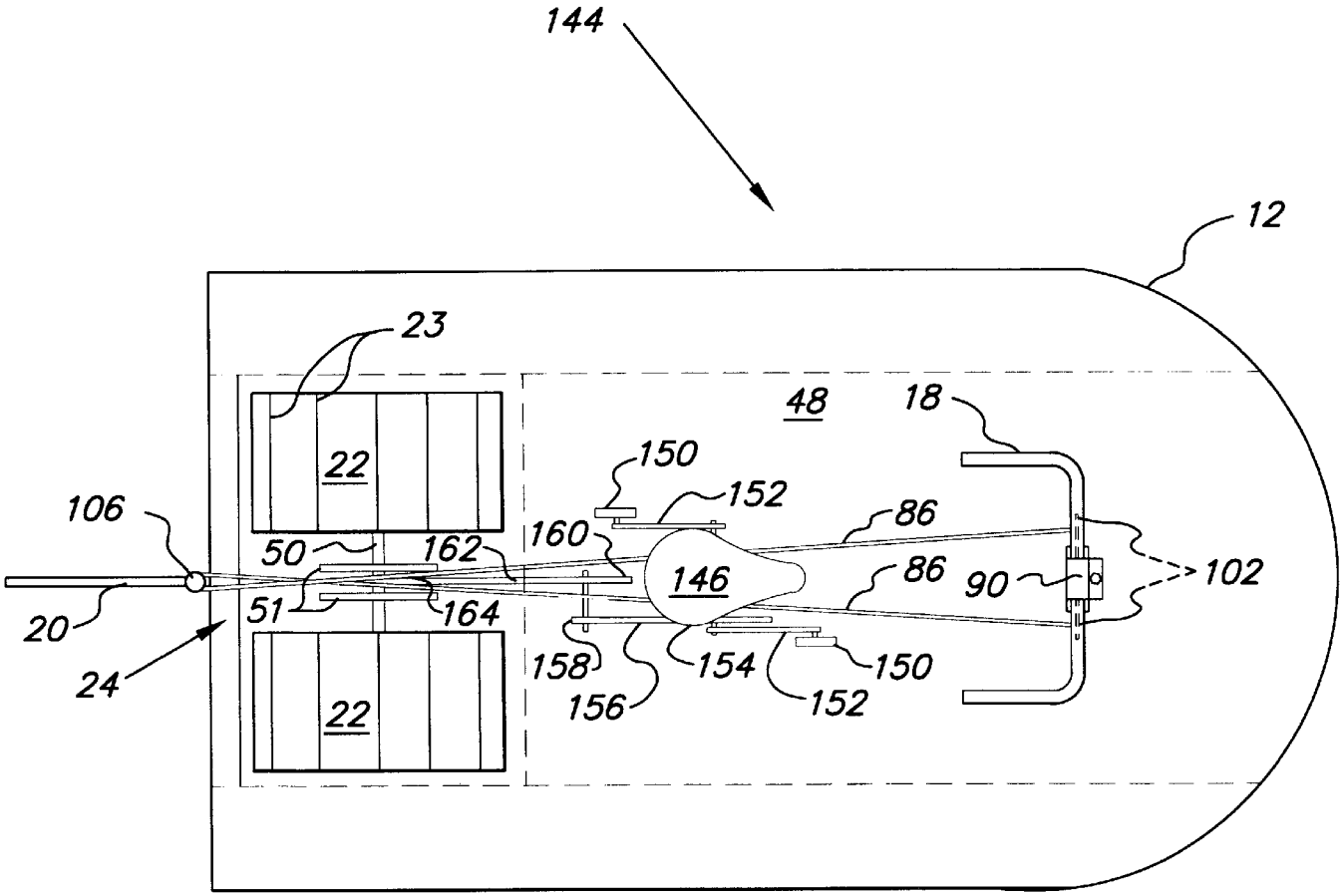
FIG. 20 is a top plan view of the FIG. 19 embodiment.
Figure 21:
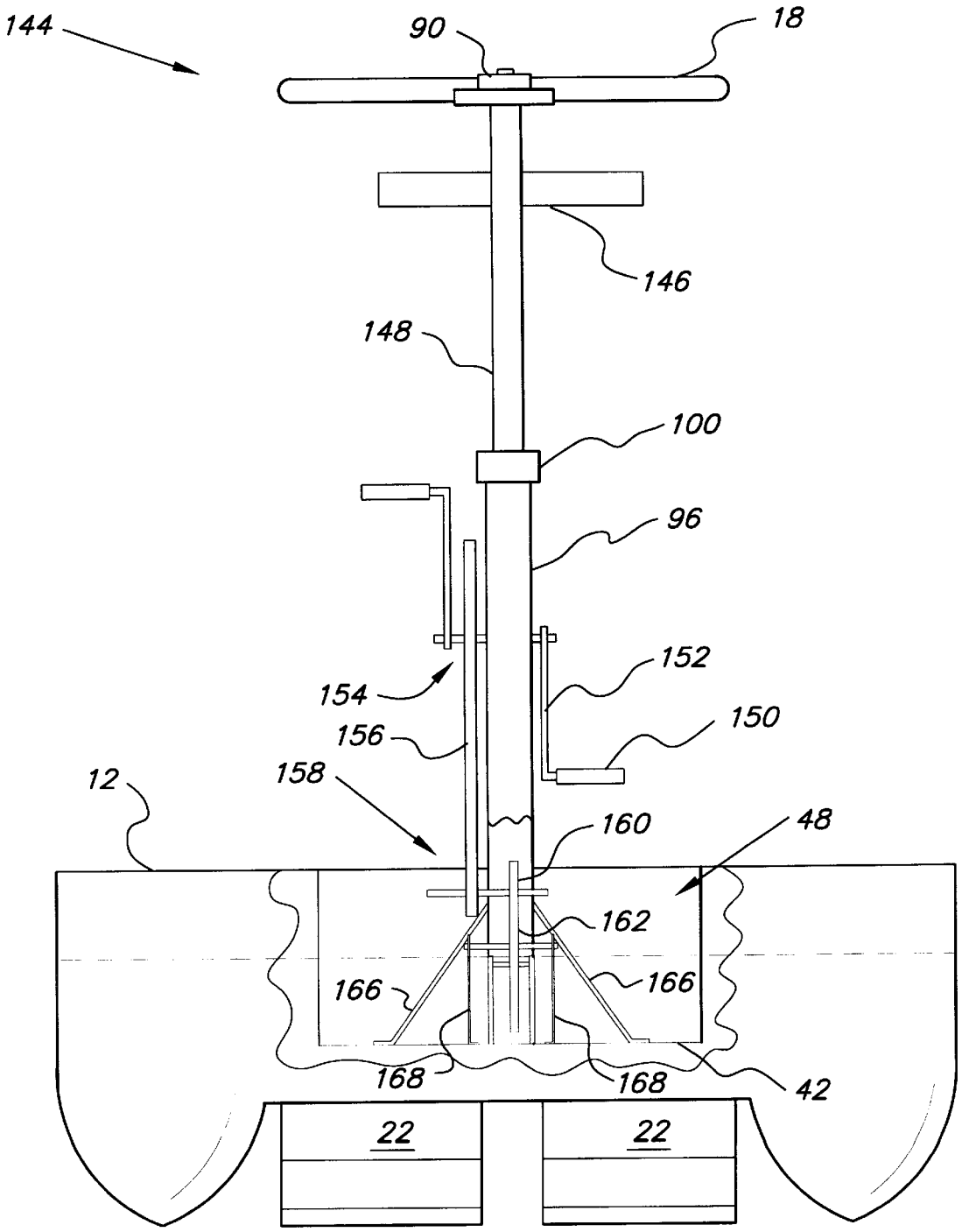
FIG. 21 is a front elevational view with a partial breakaway of the FIG. 19 embodiment.

Turning to the fourth and last embodiment of FIGS. 19–21, a cycling formatted paddleboat 144 is shown. The driving mechanism is based primarily on a bicycle drive and seat system except that V-belts are utilized instead of chains. The steering handle 18 on a steering shaft 92 with the steering posts 102 (FIG. 20) and steering rope 86 manipulates the helical gear 106 on the rudder shaft 108. The driver sits on a cycle seat 146 on a seat post 148 adjustable in height in the seat socket 149. The cycle pedals 150 and crankshafts 152 drive a first pulley 154 on which a first V-belt 156 cooperates with a second pulley 158 of a much smaller diameter attached to a third pulley 160 having a diameter similar to that of the first pulley 154. Thus, a mechanical advantage is formed driving a second V-belt 162 which cooperates with a fourth pulley 164 having a small diameter similar to that of the second pulley 158. The fourth pulley 164 drives the paddle wheels 22 with another mechanical advantage. FIG. 21 in a front view with a partial breakaway of the main steering shaft 96 shows the steering handle collar 100, a pair of seat post braces 166, and a pair of braces 168 for the third pulley 160.

In this embodiment, the direction of rotation of the paddle wheels 22 can be reversed simply by reversing the rotation of the pedals 150. Of course, this cycling boat 144 car be lifted onto a pair of boat stands 138 (FIG. 18) to provide exercise on land.

Thus, various modifications of a paddleboat using different drive systems have been shown to provide an exercise enthusiast the opportunity to enjoy water travel as well as to exercise on land using the same equipment.

It is to be understood that the present invention is not limited to the embodiments described above, but encompasses any and all embodiments within the scope of the following claims.

I claim:

1. A water workout apparatus comprising:

a cathedral boat hull having a pivotal rear rudder;

a steering handle and a vertical steering shaft, said handle attached to said shaft;

a first ratchet wheel;

a pair of forward movement pedals, each pedal mounted adjacent to said first ratchet wheel for advancing said first ratchet wheel;

a second ratchet wheel;

a pair of reverse movement pedals, each pedal mounted adjacent to a second ratchet wheel having a first diameter for advancing said second ratchet wheel;

a primary gear having said first diameter;

a main axle;

said pair of forward movement pedals, said pair of reverse movement pedals, said first ratchet wheel, said second ratchet wheel, and said primary gear mounted on said main axle;

a secondary gear of a smaller second diameter and a primary pulley having a larger diameter, said secondary gear being attached to said primary pulley, wherein said primary gear drives said secondary gear;

a forward enclosure for containing said pair of forward movement pedals, said pair of reverse movement pedals and said steering handle;

an additional axle having a secondary pulley;

a pair of paddle wheels mounted on said additional axle, said secondary pulley located between said paddle wheels, there further being a rear enclosure, said paddle wheels partially contained by said rear enclosure; and an endless belt traversing said primary pulley and said secondary pulley, for driving the paddle wheels by reciprocal movement of the forward movement and rear movement pedals.

2. The water workout apparatus according to claim 1, including a pawl on the ends of each forward and reverse movement pedal for driving each first and second ratchet wheel.

3. The water workout apparatus according to claim 1, including triangular shaped brackets each having a wide end and a narrow end, and attached to each forward and reverse movement pedal at said wide end and said narrow end pivoting on said main axle.

4. The water workout apparatus according to claim 1, including a pair of horizontal steering posts diametrically opposed on said steering shaft, an endless steering rope, and a helical gear, and to each post is attached the end of said endless steering rope, which traverses said helical gear which is positioned on a top portion of a vertical shaft of the rear rudder, whereby the water workout apparatus can be steered either forward or in reverse by reversing the handle.

5. The water workout apparatus according to claim 1, wherein there is a top clamp on the vertical steering shaft, the steering handle being U-shaped and having a pair of stopper pins in its midsection for engaging a clamp attached to the top of the vertical steering shaft.

6. The water workout apparatus according to claim 1, wherein the vertical steering shaft includes a telescopic joint for effectuating an adjustment in height of the steering handle.

7. The water workout apparatus according to claim 1, including a steering pivot socket as a base for the steering shaft for reversing the direction of the steering handle 180° to effectuate a reverse movement by utilizing the reverse movement pedals.

8. The water workout apparatus according to claim 1, including a wire mesh reinforcement matrix in a foamed polystyrene frame of the cathedral boat hull.

9. The water workout apparatus according to claim 1, including a pair of stands comprising an elevated central portion and lower shoulders on each side of each stand for supporting a cathedral hull paddleboat fore and aft on land.

10. A water workout apparatus comprising:

a cathedral hull boat having a vertical shaft and a pivotal rear rudder on said vertical shaft, there further being a helical gear at an upper end of said vertical shaft;

a steering handle bar and a vertical steering shaft, said vertical steering shaft having a pair of horizontal steering sticks diametrically opposed on the steering shaft, there further being an endless steering rope, each steering stick being attached to ends of said endless steering rope, said rope traversing the helical gear of the rear rudder;

a pair of rowing handles, a pair of forward movement pedals, a first ratchet wheel and a primary gear having a first diameter;

said pair of rowing handles attached to said pair of forward movement pedals, each pedal mounted adjacent to a said first ratchet wheel for advancing said primary gear having a first diameter;

a main axle;

said pair of forward movement pedals, said first ratchet wheel, said second ratchet wheel, and said primary gear mounted on said main axle;

a primary pulley having a larger diameter;

a secondary gear of a smaller second diameter attached to said primary pulley having a larger diameter, wherein said primary gear drives said secondary gear;

an additional axle having a secondary pulley;

a pair of paddle wheels mounted on said additional axle, said secondary pulley located between said paddle wheels, there further being a rear enclosure, said paddle wheels partially contained by said rear enclosure; and an endless belt traversing said primary pulley and said secondary pulley for driving the paddle wheels by reciprocal movement of the forward and rear movement of the rowing handles.

11. The water workout apparatus according to claim 10, wherein the pair of rowing handles are shaped in the form of question marks with the upper horizontal handle grips inwardly facing each other.

12. The water workout apparatus according to claim 10, wherein the pair of rowing handles are straight bars.

13. The water workout apparatus according to claim 10, including a combination bench seat and cooler located over the paddle wheels.

14. The water workout apparatus according to claim 10, including an elongated stool for an operator and passengers.

15. A water workout apparatus comprising:

a cathedral hull boat having a vertical shaft and a pivotal rear rudder on said vertical shaft, there further being a helical gear at an upper end of said vertical shaft;

a steering handle bar and a vertical steering shaft, said vertical steering shaft having a pair of horizontal steering sticks diametrically opposed on the steering shaft, there further being an endless steering rope, each steering stick being attached to ends of said endless steering rope, said rope traversing the helical gear of the rear rudder;

a bicycle seat, a seat post socket and a vertical post, said seat attached to said vertical post which is adjustable in height in said vertical seat post socket, said vertical post having an axle, a first pulley and a pair of crankshafts, said vertical post supporting said axle and said first pulley, there further being pivotal pedals supported by said axle;

a second pulley of small diameter and a third pulley of larger diameter, said second pulley attached to said third pulley of larger diameter, said second pulley and said first pulley connected by a first V-belt;

an additional axle with a fourth pulley;

a rear enclosure;

a pair of paddle wheels mounted on said additional axle with said fourth pulley between paddle wheels and partially contained by said rear enclosure; and a second V-belt connecting the third and fourth pulleys for transmitting a pedal power for forward and reverse movement to the paddle wheels.

16. The water workout apparatus according to claim 15, wherein the vertical steering shaft includes a telescopic joint for effectuating an adjustment in height of the steering handle.

17. The water workout apparatus according to claim 15, including a wire mesh reinforcement matrix in a foamed polystyrene frame of the cathedral hull paddleboat.

18. The water workout apparatus according to claim 15, wherein there is a top clamp on the vertical steering shaft, the steering handle being U-shaped and having a pair of stopper pins in its midsection for engaging said clamp attached to the top of the vertical steering shaft.

19. The water workout apparatus according to claim 15, wherein the vertical steering shaft includes a telescopic joint for effectuating an adjustment in height of the steering handle.

20. The water workout apparatus according to claim 15, including a pair of stands comprising an elevated central portion and lower shoulders on each side of each stand for supporting the cathedral hull paddleboat fore and aft on land.

* * * * *